US011073772B1

(12) United States Patent
Watanabe et al.

(10) Patent No.: US 11,073,772 B1
(45) Date of Patent: Jul. 27, 2021

(54) ELECTROSTATIC CHARGE IMAGE DEVELOPER, PROCESS CARTRIDGE, IMAGE FORMING APPARATUS, AND IMAGE FORMING METHOD

(71) Applicant: FUJIFILM Business Innovation Corp., Tokyo (JP)

(72) Inventors: Takuro Watanabe, Kanagawa (JP); Yasuaki Hashimoto, Kanagawa (JP); Daisuke Noguchi, Kanagawa (JP); Takashi Inukai, Kanagawa (JP); Sakiko Takeuchi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/921,208

(22) Filed: Jul. 6, 2020

(30) Foreign Application Priority Data

Jan. 28, 2020 (JP) ..... JP2020-011367

(51) Int. Cl.

| | |
|---|---|
| ***G03G 9/08*** | (2006.01) |
| ***G03G 9/093*** | (2006.01) |
| ***G03G 9/087*** | (2006.01) |
| ***G03G 15/08*** | (2006.01) |
| ***G03G 21/18*** | (2006.01) |
| ***G03G 9/113*** | (2006.01) |
| ***G03G 9/097*** | (2006.01) |
| ***G03G 9/107*** | (2006.01) |

(52) U.S. Cl.
CPC ..... *G03G 9/09335* (2013.01); *G03G 9/0819* (2013.01); *G03G 9/0821* (2013.01); *G03G 9/08755* (2013.01); *G03G 9/09342* (2013.01); *G03G 9/09708* (2013.01); *G03G 9/1075* (2013.01); *G03G 9/1138* (2013.01); *G03G 9/1139* (2013.01); *G03G 15/08* (2013.01); *G03G 21/1803* (2013.01)

(58) Field of Classification Search
CPC ..... G03G 9/09708; G03G 9/1138; G03G 9/1139; G03G 9/0819; G03G 9/0821; G03G 9/1075
USPC ..... 430/108.1, 111.1
See application file for complete search history.

(56) References Cited

FOREIGN PATENT DOCUMENTS

| | | |
|---|---|---|
| JP | 2006-317489 A | 11/2006 |
| JP | 2009-237274 A | 10/2009 |

*Primary Examiner* — Mark A Chapman
(74) *Attorney, Agent, or Firm* — Sughrue Mion, PLLC

(57) ABSTRACT

An electrostatic charge image developer contains toner particles, layered-compound particles that are particles of a nitrogen-containing layered compound, and a resin-coated carrier that has magnetic particles and a resin layer covering the magnetic particles. The maximum height Ry of the roughness profile as defined in JIS B0601: 1994 of the surface of the resin-coated carrier is 0.01 μm or more and 0.20 μm or less.

20 Claims, 2 Drawing Sheets

ELECTROSTATIC CHARGE IMAGE DEVELOPER, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2020-011367 filed Jan. 28, 2020.

BACKGROUND

(i) Technical Field

The present disclosure relates to an electrostatic charge image developer, a process cartridge, an image forming apparatus, and an image forming method.

(ii) Related Art

Japanese Unexamined Patent Application Publication No. 2006-317489 discloses a toner made with base toner and a melamine cyanurate powder. The base toner has an average roundness of 0.94 to 0.995 and a volume-average particle diameter of 3 μm to 9 μm. The melamine cyanurate powder has a volume-average particle diameter of 3 μm to 9 μm, and its amount is between 0.1 and 2.0 parts by weight per 100 parts by weight of the base toner.

Japanese Unexamined Patent Application Publication No. 2009-237274 discloses a positively charged toner made with colored resin particles and melamine cyanurate particles. The colored resin particles contain a binder resin, a coloring agent, and a positive-charge control agent. The melamine cyanurate particles have a number-average diameter (primary particles) of 0.05 μm to 1.5 μm, and their amount is between 0.01 and 0.5 parts by weight per 100 parts by weight of the colored resin particles.

SUMMARY

Aspects of non-limiting embodiments of the present disclosure relate to an electrostatic charge image developer containing toner particles and a resin-coated carrier. With electrostatic charge image developers free of particles of a nitrogen-containing layered compound or made with a resin-coated carrier for which the maximum height Ry of the roughness profile of the surface is more than 0.20 μm, continuous formation of an image of low area coverage under hot and humid conditions (temperature of 30° C. and relative humidity of 88%) has resulted in the defect called developer bead carryover, and continuous formation of an image of high area coverage under cold and dry conditions (10° C. and 15%) has resulted in the defect called toner starvation. This developer reduces both defects.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an electrostatic charge image developer. The developer contains toner particles, layered-compound particles that are particles of a nitrogen-containing layered compound, and a resin-coated carrier that has magnetic particles and a resin layer covering the magnetic particles. A maximum height Ry of the roughness profile as defined in JIS B0601: 1994 of a surface of the resin-coated carrier is 0.01 μm or more and 0.20 μm or less.

BRIEF DESCRIPTION OF THE DRAWINGS

Exemplary embodiments of the present disclosure will be described in detail based on the following figures, wherein.

DETAILED DESCRIPTION

Figure 1:
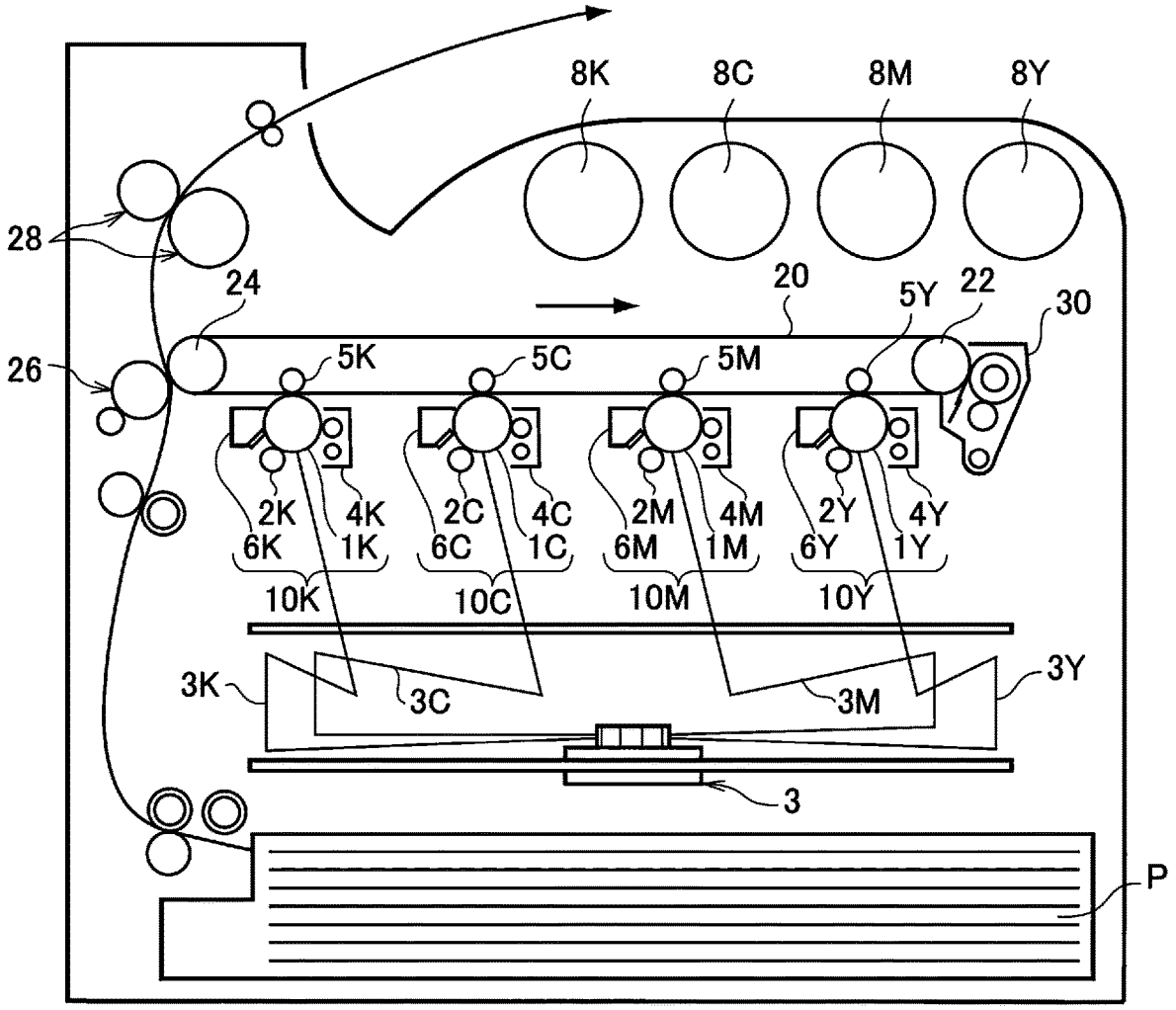
FIG. 1 schematically illustrates the structure of an example of an image forming apparatus according to an exemplary embodiment.

The following describes exemplary embodiments of the present disclosure. The following description and Examples are merely examples of the exemplary embodiments and do not limit the scope of the exemplary embodiments.

Numerical ranges specified with "A-B," "between A and B," "(from) A to B," etc., herein represent inclusive ranges, which include minimum A and maximum B as well as all values in between.

The present disclosure also mentions series of numerical ranges. The upper or lower limit of one of such numerical ranges may be substituted with the upper or lower limit of another numerical range in the same series. The upper or lower limit of a numerical range herein may be substituted with a value specified in Examples.

A gerund or action noun in the description of a certain process or method herein does not always represent an independent action. As long as its purpose is fulfilled, the action represented by the gerund or action noun may be continuous with or part of another.

A description of an exemplary embodiment herein may make reference to drawing(s). The reference, however, does not mean that what is illustrated is the only possible configuration of the exemplary embodiment. The size of elements in each drawing is conceptual; the relative sizes of the elements do not need to be as illustrated.

An ingredient herein may be a combination of multiple substances. If a composition described herein contains a combination of multiple substances as one of its ingredients, the amount of the ingredient represents the total amount of the substances in the composition unless stated otherwise.

An ingredient herein, furthermore, may be a combination of multiple kinds of particles. If a composition described herein contains a combination of multiple kinds of particles as one of its ingredients, the particle diameter of the ingredient is that of the mixture of the multiple kinds of particles present in the composition.

As used herein, the term "toner" represents a toner for developing an electrostatic charge image, and the term "carrier" represents a carrier for developing an electrostatic charge image. "An electrostatic charge image developer" herein may be simply referred to as "a developer."

Electrostatic Charge Image Developer

A developer according to an exemplary embodiment contains toner particles, layered-compound particles that are particles of a nitrogen-containing layered compound, and a resin-coated carrier that has magnetic particles and a resin layer covering the magnetic particles. The maximum height Ry of the roughness profile as defined in JIS B0601: 1994 of the surface of the resin-coated carrier is 0.01 μm or more and 0.20 μm or less.

The maximum height Ry of the roughness profile is a measure of surface roughness. The maximum height Ry of the roughness profile of the surface of the resin-coated carrier in this exemplary embodiment is measured as follows in accordance with JIS B0601: 1994.

The surface of the resin-coated carrier is observed at an appropriate magnification (e.g., ×1000) using a surface profiler (e.g., Keyence Corporation "VK-9700 Color 3D Surface Profiler/Microscope"), and a roughness profile is obtained with a cutoff of 0.08 mm. Within a sampling length of 10 μm is selected along the mean line of the roughness profile, the peak-to-valley distance Ry (μm) is calculated. The Ry of 2000 particles of the resin-coated carrier is averaged.

With the developer according to this exemplary embodiment, an image of low area coverage can be continuously formed under hot and humid conditions with reduced developer bead carryover (adhesion of the carrier to the electrostatic charge image on the surface of the image carrier of the image forming apparatus used). An image of high area coverage, moreover, can be continuously formed under cold and dry conditions with reduced toner starvation (void at the edge of the image). A possible mechanism is as follows.

In some kinds of developers, toner and a resin-coated carrier are stirred together to triboelectrically charge the toner. The stress from the stirring inside developing equipment can accelerate the wearing of the resin layer of the resin-coated carrier, thereby causing a larger area of magnetic particles to be exposed out of the resin-coated carrier. This reduces the electrical resistance of the resin-coated carrier, occasionally resulting in the defect called developer bead carryover. This defect is common in continuous formation of an image of low area coverage under hot and humid conditions (e.g., temperature of 30° C. and relative humidity of 88%); external additives do not easily become released from the toner particles (i.e., external additives do not cover the surface of the resin-coated carrier well), and the developer is exposed to continuous stress from stirring inside developing equipment.

If the developer contains particles of a nitrogen-containing layered compound, however, this defect of developer bead carryover is reduced, presumably because the layered-compound particles cover the exposed portion of the magnetic particles on the surface of the resin-coated carrier. By virtue of the nitrogen atoms therein, the particles of a nitrogen-containing layered compound are electrostatically attracted to the exposed portion of the magnetic particles more strongly than to the resin layer. The attracted layered-compound particles (particles of a compound that has a layered structure with an interlayer distance on the order of Angstroms), the inventors believe, adhere to and cover the exposed portion of the magnetic particles.

Excessive covering of the exposed portion of the magnetic particles on the surface of the resin-coated carrier with materials in the developer or their debris (e.g., external additives, flakes of resin from the toner particles, and flakes of resin from the resin-coated carrier), however, increases the electrical resistance, occasionally resulting in the defect called toner starvation. This defect is common in continuous formation of an image of high area coverage under cold and dry conditions (e.g., temperature of 10° C. and relative humidity of 15%); external additives easily become released from the toner particles (i.e., external additives cover the surface of the resin-coated carrier well), and the toner stays in developing equipment only for a short time (i.e., the triboelectric charging of the toner tends to be insufficient.

If the maximum height Ry of the roughness profile of the surface of the resin-coated carrier is 0.20 μm or less, however, this defect of toner starvation is reduced, presumably because the materials in the developer or their debris are no longer easily caught on the surface of the resin-coated carrier and, therefore, does not cover the exposed portion of the magnetic particles excessively. In light of this, the maximum height Ry of the roughness profile of the surface of the resin-coated carrier may be 0.15 μm or less, preferably 0.10 μm or less, more preferably 0.08 μm or less. Since it is difficult to smooth out all minor irregularities, the maximum height Ry of the roughness profile of the surface of the resin-coated carrier is 0.01 μm or more. Ry may be 0.04 μm or more for easier production.

Examples of how to control the maximum height Ry of the roughness profile of the surface of the resin-coated carrier include the use of magnetic particles having smaller surface irregularities; and forming the resin layer relatively thick.

The formation of the resin layer on the surface of the magnetic particles may be by a wet process (in which the resin is dissolved or dispersed in solvent) or dry process (in which the resin is not dissolved or dispersed in solvent), but dry processes help ensure a low maximum height Ry of the roughness profile of the surface of the resin-coated carrier. An example of an exemplary embodiment of a dry process will be described later herein.

The following describes the resin-coated carrier, layered-compound particles, and toner particles as components the developer according to this exemplary embodiment in detail.

Resin-Coated Carrier

The resin-coated carrier has magnetic particles and a resin layer covering the magnetic particles.

Magnetic Particles

The magnetic particles may be of any known type of magnetic particles that are used as a core material for a carrier. Specific examples of magnetic particles include particles of magnetic metals, such as iron, nickel, and cobalt; particles of magnetic oxides, such as ferrite and magnetite; resin-impregnated magnetic particles, which are made by impregnating a porous magnetic powder with resin; and magnetic powder-dispersed resin particles, which are made by dispersing and mixing magnetic particles in resin. In this exemplary embodiment, ferrite particles are preferred.

The volume-average diameter of the magnetic particles may be 10 μm or more and 100 μm or less, preferably 20 μm or more and 80 μm or less, more preferably 30 μm or more and 60 μm or less.

As for the magnetic force of the magnetic particles, the saturation magnetization in a magnetic field of 3000 Oersteds may be 50 emu/g or more, preferably 60 emu/g or more. This saturation magnetization is measured using VSMP10-15 vibrating sample magnetometer (Toei Industry). The sample for measurement is loaded into a cell measuring 7 mm in inner diameter and 5 mm in height, and this cell is set in the magnetometer. A magnetic field is applied to the sample and gradually increased up to 3000 Oersteds. The magnetic field applied is then reduced to draw a hysteresis loop on chart paper. The saturation magnetization, remnant magnetization, and coercivity are determined from data from the loop.

The electrical volume resistance (volume resistivity) of the magnetic particles may be $1\times10^5$ Ω·cm or more and $1\times10^9$ Ω·cm or less, preferably $1\times10^7$ Ω·cm or more and $1\times10^9$ Ω·cm or less.

The measurement of the electrical volume resistance (Ω·cm) of the magnetic particles is as follows. On the surface of a round jig having 20-$cm^2$ plate electrodes, the subject of measurement is spread to form a flat layer with a thickness of 1 mm or more and 3 mm or less. A 20-$cm^2$ plate electrode is placed on this layer to sandwich the layer between the electrodes. A load of 4 kg is placed on the upper electrode to eliminate the space between the subject and the electrode, and then the thickness of the layer (cm) is measured. The two electrodes, on and below the layer, have been connected to an electrometer and a high-voltage power supply. A high voltage is applied to the electrodes to produce an electric field of 103.8 V/cm, and the current reading (A) is recorded. The measurement is performed under the conditions of a temperature of 20° C. and a humidity of 50% RH, and the electrical volume resistance (Ω·cm) of the subject is calculated in accordance with the following equation.

$$R=E\times 20/(I-I_0)/L$$

In the equation, R represents the electrical volume resistance (Ω·cm) of the subject, E represents the voltage applied (V), I represents electrical current (A), $I_0$ represents the electrical current (A) at an applied voltage of 0 V, and L represents the thickness (cm) of the layer. The coefficient 20 is the area ($cm^2$) of the plate electrodes.

Resin Layer Covering the Magnetic Particles

Examples of resins for the resin layer include styrene-acrylic acid copolymers; polyolefin resins, such as polyethylene and polypropylene; polyvinyl or polyvinylidene resins, such as polystyrene, acrylic resins, polyacrylonitrile, polyvinyl acetate, polyvinyl alcohol, polyvinyl butyral, polyvinyl chloride, polyvinyl carbazole, polyvinyl ether, and polyvinyl ketone; vinyl chloride-vinyl acetate copolymers; straight silicone resins, formed by organosiloxane bonds, or their modified forms; fluoropolymers, such as polytetrafluoroethylene, polyvinyl fluoride, polyvinylidene fluoride, and polychlorotrifluoroethylene; polyesters; polycarbonates; amino resins, such as urea-formaldehyde resins; and epoxy resins.

The resin layer may contain an alicyclic acrylic resin. The alicyclic acrylic resin may be polymerized from a lower-alkyl ester of (meth)acrylic acid (e.g., an alkyl ester of (meth)acrylic acid with a C1-9 alkyl group), and specific examples of such esters include methyl (meth)acrylate, ethyl (meth)acrylate, propyl (meth)acrylate, butyl (meth)acrylate, hexyl (meth)acrylate, cyclohexyl (meth)acrylate, and 2-ethylhexyl (meth)acrylate. One such monomer may be used alone, or two or more may be used in combination.

Preferably, the alicyclic acrylic resin is polymerized from monomers including cyclohexyl (meth)acrylate. The cyclohexyl (meth)acrylate content of the alicyclic acrylic resin may be 75 mol % or more and 100 mol % or less, preferably 85 mol % or more and 100 mol % or less, more preferably 95 mol % or more and 100 mol % or less.

The percentage of alicyclic acrylic resins in the resin layer may be 80% by mass or more, preferably 90% by mass or more. It is more preferred that the resin layer be substantially a layer of alicyclic acrylic resin(s).

The resin layer may contain inorganic particles for the control of charging and electrical resistance. Examples of inorganic particles include carbon black; particles of metals, such as gold, silver, and copper; particles of metal compounds, such as barium sulfate, aluminum borate, potassium titanate, titanium oxide, zinc oxide, tin oxide, antimony-doped tin oxide, tin-doped indium oxide, and aluminum-doped zinc oxide; and metal-coated resin particles.

The formation of the resin layer on the surface of the magnetic particles is by, for example, a wet process or dry process. In wet processes, the resin(s) for the resin layer is dissolved or dispersed in solvent. In dry processes, no solvent is used.

Examples of wet processes include dipping, in which the magnetic particles are immersed in a resin liquid; spraying, in which a resin liquid is sprayed onto the surface of the magnetic particles; fluidized bed coating, in which a resin liquid is sprayed onto magnetic particles floated on a stream of air; and kneader-coater coating, in which the magnetic particles and a resin liquid are mixed in a kneader-coater, and then the solvent is removed.

In wet processes, the resin(s) and other ingredients are dissolved or dispersed in solvent to give a resin liquid for the formation of the resin layer. The solvent may be of any kind as long as the resin(s) can be dissolved or dispersed therein. Examples include aromatic hydrocarbons, such as toluene and xylene; ketones, such as acetone and methyl ethyl ketone; and ethers, such as tetrahydrofuran and dioxane.

For dry processes, an example is to heat a dry mixture of the magnetic particles and the resin(s) to form a resin layer. Specifically, for example, the magnetic particles and the resin(s) are mixed in a gas phase, and the mixture is melted by heating to form a resin layer.

The following describes dry coating as an example of an exemplary embodiment of a dry process.

In dry coating, resin particles are attached to the surface of the magnetic particles to be covered, and then mechanical impact is applied to melt or soften the resin particles adhering to the surface of the magnetic particles to form a resin layer. Specifically, a mixture of the magnetic particles and resin particles (and optionally inorganic particles to be contained in the resin layer) is loaded into a high-speed stirring mixer, which will produce the mechanical impact, and repeatedly exposed to impact by vigorous stirring with or without heating. The stirring force may be, for example, wind power.

If the mixture is heated during the stirring, the heating temperature may be 80° C. or more and 130° C. or less. The wind velocity for the stirring may be 10 m/s or more during heating. During cooling, the wind velocity may be 5 m/s or less so that the aggregation between particles of the resin-coated carrier will be limited. The length of time for which the impact is applied may be 20 minutes or more and 60 minutes or less.

During or after the production of the resin-coated carrier in this way, the magnetic particles may be exposed, for example by removing part of the resin layer by applying mechanical stress to the resin-coated carrier. Examples of how to do this include increasing the wind velocity during cooling to produce a shear force that will remove part of the resin layer; applying the impact for a prolonged period (e.g., 90 minutes or longer) to move resin from projections to depressions in the surface of the resin-coated carrier and thereby to expose the magnetic particles at the projections; and stirring the produced resin-coated carrier, for example using a Turbula mixer, ball mill, or vibration mill, to remove part of the resin layer.

The thickness of the resin layer may be 0.1 μm or more and 10 μm or less, preferably 0.3 μm or more and 5 μm or less.

The percentage of exposed magnetic particles on the surface of the resin-coated carrier may be 1% or more and 20% or less, preferably 2% or more and 10% or less, more preferably 3% or more and 8% or less.

The percentage of exposed magnetic particles on the surface of the resin-coated carrier is determined by x-ray photoelectron spectroscopy (XPS) as follows.

Bare magnetic particles are prepared by removing the resin layer from the resin-coated carrier of interest, for example by dissolving the resin component in an organic solvent or heating the carrier at approximately 800° C. to eliminate the resin component. The Fe content (atomic %) of the resin-coated carrier and that of the bare magnetic particles are measured by XPS. (The Fe content of the resin-coated carrier)/(the Fe content of the magnetic particles)× 100 is the percentage (%) of exposed magnetic particles.

The percentage of exposed magnetic particles in the resin-coated carrier may be controlled by changing the amount of resin used to form the resin layer. The percentage of exposed particles decreases with increasing amount of resin relative to the amount of the magnetic particles.

The volume-average diameter of particles in the resin-coated carrier may be 10 μm or more and 120 μm or less, preferably 20 μm or more and 100 μm or less, more preferably 30 μm or more and 80 μm or less.

In the developer according to this exemplary embodiment, the ratio (by mass) in which the resin-coated carrier and the toner particles are mixed may be between 100:1 (resin-coated carrier:toner particles) and 100:30, preferably between 100:3 and 100:20.

Layered-Compound Particles

Layered-compound particles are particles of a compound that has a layered structure. Examples of particles of a nitrogen-containing layered compound include melamine cyanurate particles and boron nitride particles.

The volume-average diameter of the layered-compound particles may be 0.1 μm or more and 20 μm or less. This helps reduce developer bead carryover. Layered-compound particles having a volume-average diameter of 20 μm or less appear to adhere easily to exposed portions of the magnetic particles on the surface of the resin-coated carrier. Layered-compound particles having a volume-average diameter of 0.1 μm or more appear to cover well exposed portions of the magnetic particles after adhering there on the surface of the resin-coated carrier.

In light of these, the volume-average diameter of the layered-compound particles may be 0.3 μm or more and 10 μm or less, preferably 1 μm or more and 8 μm or less, more preferably 2 μm or more and 6 μm or less.

Possible ways to control the volume-average diameter of the layered-compound particles include milling, classification, and a combination of milling and classification.

The ratio between the volume-average diameter Da of the layered-compound particles and the volume-average diameter Db of the resin-coated carrier, Da/Db, may be 0.02 or more and 0.8 or less, preferably 0.03 or more and 0.7 or less, more preferably 0.04 or more and 0.6 or less.

The volume-average diameter of the layered-compound particles is determined as follows.

First, the layered-compound particles are isolated from the developer. The isolation of the layered-compound particles from the developer may be by any method. For example, the developer is dispersed in water containing a surfactant, and the resulting liquid dispersion is sonicated. The sonicated dispersion is centrifuged at a high speed to separate the toner particles, the layered-compound particles, and any other external additives by specific gravity. The fraction containing the layered-compound particles is collected. Drying the collected fraction gives the layered-compound particles.

Then the layered-compound particles are added to an aqueous solution of an electrolyte (e.g., an aqueous solution of ISOTON), and the resulting mixture is sonicated for 30 seconds or longer to disperse the particles. The diameter of at least 3000 layered-compound particles in the resulting liquid dispersion is measured using a laser diffraction particle size distribution analyzer (e.g., Microtrac MT3000 II, MicrotracBEL). In the particle size distribution on a volume basis, the particle diameter at which the cumulative volume of particles from the smallest diameter is 50% is the volume-average diameter of the layered-compound particles.

The layered-compound particle content may be 0.01 parts by mass or more per 100 parts by mass of the toner particles. This helps reduce developer bead carryover. The layered-compound particle content may be 0.50 parts by mass or less per 100 parts by mass of the toner particles. This helps reduce toner starvation.

In light of these, the layered-compound particle content may be 0.01 parts by mass or more and 0.30 parts by mass or less, preferably 0.03 parts by mass or more and 0.30 parts by mass or less, more preferably 0.05 parts by mass or more and 0.15 parts by mass or less per 100 parts by mass of the toner particles.

Toner Particles

The toner particles contain, for example, a binder resin, optionally with a coloring agent, a release agent, and/or other additives.

Binder Resin

Examples of binder resins include vinyl resins that are homopolymers of monomers such as styrenes (e.g., styrene, para-chlorostyrene, and α-methylstyrene), (meth)acrylates (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene, and butadiene) or copolymers of two or more such monomers.

Non-vinyl resins, such as epoxy resins, polyester resins, polyurethane resins, polyamide resins, cellulose resins, polyether resins, and modified rosin, mixtures of any such resin and vinyl resin(s), and graft copolymers obtained by polymerizing a vinyl monomer in the presence of any such non-vinyl resin may also be used.

One such binder resin may be used alone, or two or more may be used in combination.

Polyester resins may be used as binder resins.

Examples of polyester resins include known amorphous polyester resins. A combination of amorphous and crystalline polyester resins may also be used. In that case, the percentage of the crystalline polyester resin may be 2% by mass or more and 40% by mass or less (preferably 2% by mass or more and 20% by mass or less) of all binder resins.

It should be noted that if a resin is "crystalline" herein, it means that the endothermic profile of the resin as measured by differential scanning calorimetry (DSC) is not stepwise but has a clear peak, specifically a peak with a half width of 10° C. or narrower in DSC performed at a temperature elevation rate of 10 (° C./min).

The endothermic profile of an "amorphous" resin by DSC, by contrast, is stepwise or has no clear peak, or has a peak with a half width boarder than 10° C. under the same conditions.

Amorphous Polyester Resin

An example of an amorphous polyester resin is a polycondensate of a polycarboxylic acid and a polyhydric alcohol. An amorphous polyester resin may be a commercially available one or may be a synthesized one.

Examples of polycarboxylic acids include aliphatic dicarboxylic acids (e.g., oxalic acid, malonic acid, maleic acid, fumaric acid, citraconic acid, itaconic acid, glutaconic acid, succinic acid, alkenylsuccinic acids, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), and anhydrides or lower-alkyl (e.g., C1-5 alkyl) esters of such acids. Aromatic dicarboxylic acids, for example, are preferred.

A dicarboxylic acid may be used in combination with a crosslinked or branched carboxylic acid having three or more carboxylic groups. Examples of carboxylic acids having three or more carboxylic groups include trimellitic acid, pyromellitic acid, and anhydrides or lower-alkyl (e.g., C1-5 alkyl) esters of these acids.

One polycarboxylic acid may be used alone, or two or more may be used in combination.

Examples of polyhydric alcohols include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adducts of bisphenol A and propylene oxide adducts of bisphenol A). Aromatic diols and alicyclic diols, for example, are preferred, and aromatic diols are more preferred.

A diol may be used in combination with a crosslinked or branched polyhydric alcohol having three or more hydroxyl groups. Examples of polyhydric alcohols having three or more hydroxyl groups include glycerol, trimethylolpropane, and pentaerythritol.

One polyhydric alcohol may be used alone, or two or more may be used in combination.

The glass transition temperature (Tg) of the amorphous polyester resin may be 50° C. or more and 80° C. or less, preferably 50° C. or more and 65° C. or less.

This glass transition temperature is determined from the DSC curve of the resin, which is measured by differential scanning calorimetry (DSC), or more specifically is the "extrapolated initial temperature of glass transition" as in the methods for determining glass transition temperatures set forth in JIS K7121: 1987 "Testing Methods for Transition Temperatures of Plastics."

The weight-average molecular weight (Mw) of the amorphous polyester resin may be 5000 or more and 1000000 or less, preferably 7000 or more and 500000 or less.

The number-average molecular weight (Mn) of the amorphous polyester resin may be 2000 or more and 100000 or less.

The molecular weight distribution, Mw/Mn, of the amorphous polyester resin may be 1.5 or more and 100 or less, preferably 2 or more and 60 or less.

These weight- and number-average molecular weights are measured by gel permeation chromatography (GPC). The analyzer is Tosoh's HLC-8120 GPC chromatograph with Tosoh's TSKgel SuperHM-M column (15 cm), and the eluate is tetrahydrofuran (THF). Comparing the measurements with a molecular-weight calibration curve prepared using monodisperse polystyrene standards gives the weight- and number-average molecular weights.

The production of the amorphous polyester resin may be by a known method. A specific example is to polymerize raw materials at a temperature of 180° C. or more and 230° C. or less. The reaction system may optionally be evacuated to remove the water and alcohol that are produced as condensation proceeds.

If the raw-material monomers do not dissolve or are not miscible together at the reaction temperature, a solvent having a high boiling point may be added as a solubilizer to make the monomers dissolve. In that case, the solubilizer is removed by distillation during the polycondensation. Any monomer not miscible with the other(s) may be condensed with the planned counterpart acid(s) or alcohol(s) before the polycondensation process.

Crystalline Polyester Resin

An example of a crystalline polyester resin is a polycondensate of a polycarboxylic acid and a polyhydric alcohol. A crystalline polyester resin may be a commercially available one or may be a synthesized one.

The crystalline polyester resin may be a polycondensate made with linear aliphatic polymerizable monomers rather than aromatic ones. This helps the resin form its crystal structure.

Examples of polycarboxylic acids include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (e.g., dibasic acids, such as phthalic acid, isophthalic acid, terephthalic acid, and naphthalene-2,6-dicarboxylic acid), and anhydrides or lower-alkyl (e.g., C1-5 alkyl) esters of such acids.

A dicarboxylic acid may be used in combination with a crosslinked or branched carboxylic acid having three or more carboxylic groups. Examples of carboxylic acids having three or more carboxylic groups include aromatic carboxylic acids (e.g., 1,2,3-benzenetricarboxylic acid, 1,2,4-benzenetricarboxylic acid, and 1,2,4-naphthalenetricarboxylic acid) and anhydrides or lower-alkyl (e.g., C1-5 alkyl) esters of such acids.

A dicarboxylic acid such as listed above may be used in combination with a dicarboxylic acid having a sulfonic acid group and/or a dicarboxylic acid having an ethylenic double bond.

One polycarboxylic acid may be used alone, or two or more may be used in combination.

Examples of polyhydric alcohols include aliphatic diols (e.g., C7-20 linear aliphatic diols). Examples of aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. 1,8-Octanediol, 1,9-nonanediol, and 1,10-decanediol are preferred.

A diol may be used in combination with a crosslinked or branched alcohol having three or more hydroxyl groups. Examples of alcohols having three or more hydroxyl groups include glycerol, trimethylolethane, trimethylolpropane, and pentaerythritol.

One polyhydric alcohol may be used alone, or two or more may be used in combination.

The percentage of aliphatic diols in the polyhydric alcohol (s) may be 80 mol % or more, preferably 90 mol % or more.

The melting temperature of the crystalline polyester resin may be 50° C. or more and 100° C. or less, preferably 55° C. or more and 90° C. or less, more preferably 60° C. or more and 85° C. or less.

This melting temperature is the "peak melting temperature" of the resin as in the methods for determining melting temperatures set forth in JIS K7121: 1987 "Testing Methods for Transition Temperatures of Plastics" and is determined from the DSC curve of the resin, which is measured by differential scanning calorimetry (DSC).

The weight-average molecular weight (Mw) of the crystalline polyester resin may be 6,000 or more and 35,000 or less.

The production of the crystalline polyester resin may be by a known method. For example, the crystalline polyester resin may be produced in the same way as the amorphous polyester resin.

The binder resin content may be 40% by mass or more and 95% by mass or less, preferably 50% by mass or more and 90% by mass or less, more preferably 60% by mass or more and 85% by mass or less of the toner particles as a whole.

Coloring Agent

Examples of coloring agents include pigments, such as carbon black, chrome yellow, Hansa yellow, benzidine yellow, threne yellow, quinoline yellow, pigment yellow, permanent orange GTR, pyrazolone orange, Vulcan orange, Watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, Calco oil blue, methylene blue chloride, phthalocyanine blue, pigment blue, phthalocyanine green, and malachite green oxalate; and dyes, such as acridine, xanthene, azo, benzoquinone, azine, anthraquinone, thioindigo, dioxazine, thiazine, azomethine, indigo, phthalocyanine, aniline black, polymethine, triphenylmethane, diphenylmethane, and thiazole dyes.

One coloring agent may be used alone, or two or more may be used in combination.

The coloring agent(s) may optionally be surface-treated, or may be used in combination with a dispersant. Multiple coloring agents may be used.

The coloring agent content may be 1% by mass or more and 30% by mass or less, preferably 3% by mass or more and 15% by mass or less, of the toner particles as a whole.

Release Agent

Examples of release agents include hydrocarbon waxes; natural waxes, such as carnauba wax, rice wax, and candelilla wax; synthesized or mineral/petroleum waxes, such as montan wax; and ester waxes, such as fatty acid esters and montanates. Other release agents may also be used.

The melting temperature of the release agent may be 50° C. or more and 110° C. or less, preferably 60° C. or more and 100° C. or less.

This melting temperature is the "peak melting temperature" of the release agent as in the methods for determining melting temperatures set forth in JIS K7121: 1987 "Testing Methods for Transition Temperatures of Plastics" and is determined from the DSC curve of the release agent, which is measured by differential scanning calorimetry (DSC).

The release agent content may be 1% by mass or more and 20% by mass or less, preferably 5% by mass or less and 15% by mass or less, of the toner particles as a whole.

Other Additives

Examples of other additives include known additives, such as magnetic substances, charge control agents, and inorganic powders. Such additives, if used, are contained in the toner particles as internal additives.

Characteristics and Other Details of the Toner Particles

The toner particles may be single-layer toner particles or may be so-called core-shell toner particles, i.e., toner particles formed by a core section (core particle) and a coating layer that covers the core section (shell layer).

Core-shell toner particles may be formed by, for example, a core section made with a binder resin and optionally additives, such as a coloring agent and/or a release agent, and a coating layer made with a binder resin.

The volume-average diameter (D50v) of the toner particles may be 2 μm or more and 10 μm or less, preferably 4 μm or more and 8 μm or less.

The volume-average diameter (D50v) of the toner particles is measured using a Coulter Multisizer II (Beckman Coulter) and an ISOTON-II electrolyte (Beckman Coulter).

Specifically, 0.5 mg or more and 50 mg or less of the toner particles as a sample for measurement is added to 2 ml of a 5% by mass aqueous solution of a surfactant (e.g., a sodium alkylbenzene sulfonate) as a dispersant. The resulting dispersion is added to 100 ml or more and 150 ml or less of the electrolyte.

The electrolyte with the sample suspended therein is sonicated for 1 minute using a sonicator. Using Coulter Multisizer II with an aperture size of 100 μm, the size distribution of 50000 sampled particles between 2 μm and 60 μm (diameter) is measured. The particle size distribution by volume is plotted, starting from the smallest diameter. The particle diameter at which the cumulative volume is 50% is the volume-average diameter D50v.

The average roundness of the toner particles may be 0.94 or more and 1.00 or less, preferably 0.95 or more and 0.98 or less.

The average roundness of the toner particles is given by (circumference of the equivalent circle)/(circumference) [(circumference of circles having the same projected area as particle images)/(circumference of projected images of the particles)]. Specifically, it is a value measured as follows.

First, a portion of the toner particles of interest is collected by aspiration to form a flat stream. This flat stream is photographed with a flash to capture the figures of the particles in a still image. The images of 3500 sampled particles are analyzed using a flow particle-image analyzer (Sysmex FPIA-3000), and the average roundness is determined from the results.

If the developer contains external additives, the external additives are removed beforehand by dispersing the developer in water containing a surfactant and sonicating the resulting dispersion.

Production of the Toner Particles

The production of the toner particles may be by a dry process (e.g., kneading and milling) or wet process (e.g., aggregation and coalescence, suspension polymerization, or dissolution and suspension). Any known dry or wet process may be used. Preferably, the toner particles are obtained by aggregation and coalescence.

Specifically, if the toner particles are produced by, for example, aggregation and coalescence, the process includes preparing a liquid dispersion of the resin particles that will serve as a binder resin (preparation of a liquid dispersion of resin particles), allowing the resin particles (and optionally other kind(s) of particles) to form aggregates in the liquid dispersion (or a liquid dispersion prepared by mixing with other liquid dispersion(s) of particles) (formation of aggregates), and heating the resulting liquid dispersion of aggregates to make the aggregates fuse and coalesce together, thereby forming toner particles (fusion and coalescence).

In the following, this process is described in detail.

It should be noted that the method described below gives toner particles that contain a coloring agent and a release agent, but the coloring agent and the release agent are optional. Naturally, additives other than a coloring agent and a release agent may also be used.

Preparation of a Liquid Dispersion of Resin Particles

First, a liquid dispersion of the resin particles that will serve as a binder resin is prepared. A liquid dispersion of coloring-agent particles and a liquid dispersion of release-agent particles, for example, are also prepared.

The preparation of the liquid dispersion of resin particles is by, for example, dispersing the resin particles in a dispersion medium using a surfactant.

An example of a dispersion medium for the liquid dispersion of resin particles is an aqueous medium.

Examples of aqueous media include types of water, such as distilled water and deionized water, and alcohols. One such dispersion medium may be used alone, or two or more may be used in combination.

Examples of surfactants include anionic surfactants, such as sulfates, sulfonates, phosphates, and soap surfactants; cationic surfactants, such as amine salts and quaternary ammonium salts; and nonionic surfactants, such as polyethylene glycol surfactants, ethylene oxide adducts of alkylphenols, and polyhydric alcohols. Anionic surfactants and cationic surfactants are preferred. Nonionic surfactants may be used in combination with an anionic or cationic surfactant.

One surfactant may be used alone, or two or more may be used in combination.

In the preparation of the liquid dispersion of resin particles, the resin particles may be dispersed in the dispersion medium by a commonly used dispersion technique, such as a rotary-shear homogenizer or a medium mill, e.g., a ball mill, sand mill, or Dyno-Mill. For certain types of resin particles, phase inversion emulsification may be used. Phase inversion emulsification is a technique in which the resin to be dispersed is dissolved in a hydrophobic organic solvent in which the resin is soluble, the resulting organic continuous phase (O phase) is neutralized with a base, and then an aqueous medium (W phase) is added to invert the phases from W/O to O/W, thereby dispersing particles of the resin in the aqueous medium.

The volume-average diameter of the resin particles to be dispersed in the liquid dispersion may be, for example, 0.01 μm or more and 1 μm or less, preferably 0.08 μm or more and 0.8 μm or less, more preferably 0.1 μm or more and 0.6 μm or less.

The volume-average diameter of the resin particles is measured as follows. That is, the size distribution of the particles is measured using a laser-diffraction particle size distribution analyzer (e.g., HORIBA LA-700). The measured distribution is divided into segments by particle size (channels), and the cumulative distribution of volume is plotted starting from the smallest diameter. The particle diameter at which the cumulative volume is 50% of the total volume of the particles is the volume-average diameter D50v of the particles. For the other liquid dispersions, too, the measurement of the volume-average diameter of particles therein is the same.

The resin particle content of the liquid dispersion of resin particles may be 5% by mass or more and 50% by mass or less, preferably 10% by mass or more and 40% by mass or less.

The liquid dispersion of coloring-agent particles and that of release-agent particles, for example, are also prepared in the same way as the liquid dispersion of resin particles. The above description about the volume-average diameter of particles, dispersion medium, how to disperse the particles, and the particle content for the liquid dispersion of resin particles therefore also applies to the coloring-agent particles and the release-agent particles in their respective liquid dispersions.

Formation of Aggregates

Then, the liquid dispersion of resin particles is mixed with the liquid dispersion of coloring-agent particles and the liquid dispersion of release-agent particles.

In the mixture of liquid dispersions, the resin particles, the coloring-agent particles, and the release-agent particles are allowed to aggregate together. This process of heteroaggregation is continued until aggregates of the resin particles, the coloring-agent particles, and the release-agent particles grow to a diameter close to the planned diameter of the toner particles.

Specifically, for example, a flocculant is added to the mixture of liquid dispersions. The pH of the mixture is adjusted to an acidic level (e.g., a pH of 2 or more and 5 or less), optionally followed by the addition of a dispersion stabilizer. The mixture of liquid dispersions is then heated to a temperature close to the glass transition temperature of the resin particles (specifically, for example, a temperature higher than or equal to the glass transition temperature the resin particles−30° C. but not higher than the glass transition temperature of the resin particles−10° C.). This makes the particles dispersed in the mixture form aggregates.

In the formation of aggregates, for example, the mixture of liquid dispersions may be stirred using a rotary-shear homogenizer, and the flocculant may be added at room temperature (e.g., 25° C.) with the mixture stirred. Then the pH of the mixture is adjusted to an acidic level (e.g., a pH of 2 or more and 5 or less), optionally followed by the addition of a dispersion stabilizer, and the mixture is heated as described above.

Examples of flocculants include surfactants that have the opposite polarity to the surfactant(s) contained in the mixture of liquid dispersions, inorganic metal salts, and metal complexes having a valency of 2 or more. The use of a metal complex as a flocculant improves charging characteristics because less surfactant is used in that case.

Optionally, an additive that forms a complex or similar bond with metal ions from the flocculant may be used. An example is a chelating agent.

Examples of inorganic metal salts include metal salts, such as calcium chloride, calcium nitrate, barium chloride, magnesium chloride, zinc chloride, aluminum chloride, and aluminum sulfate; and polymers of inorganic metal salts, such as polyaluminum chloride, polyaluminum hydroxide, and calcium polysulfide.

The chelating agent may be a water-soluble one. Examples of chelating agents include oxycarboxylic acids, such as tartaric acid, citric acid, and gluconic acid; and aminocarboxylic acids, such as iminodiacetic acid (IDA), nitrilotriacetic acid (NTA), and ethylenediaminetetraacetic acid (EDTA).

The amount of chelating agent added may be 0.01 parts by mass or more and 5.0 parts by mass or less, preferably 0.1 parts by mass or more and less than 3.0 parts by mass, per 100 parts by mass of the resin particles.

Fusion and Coalescence

Then, the aggregates are caused to fuse and coalesce together to form toner particles, for example by heating the liquid dispersion of aggregates to a temperature equal to or higher than the glass transition temperature of the resin particles (e.g., 10° C. to 30° C. higher than the glass transition temperature of the resin particles).

In this way, the toner particles are obtained.

Alternatively, the liquid dispersion of aggregates prepared may be mixed with another volume of the liquid dispersion of resin particles. The aggregates and the resin particles are caused to aggregate together in such a manner that additional resin particles will adhere to the surface of the aggregates, forming a second form of aggregates. The liquid dispersion of the second form of aggregates is heated to make the second form of aggregates fuse and coalesce together to form core/shell toner particles.

After the end of fusion and coalescence, the toner particles, formed in a solution, are washed, separated from the solution, and dried by known methods to give dry toner particles. The washing may be by sufficient replacement with deionized water in view of chargeability. The separation from the solution may be by suction filtration, pressure filtration, etc., in view of productivity. The drying may be by lyophilization, flash drying, fluidized drying, vibrating fluidized drying, etc., in view of productivity.

The developer according to this exemplary embodiment is then produced, for example by adding external additives to the dry toner particles and mixing them. The mixing may be through the use of, for example, a V-blender, Henschel mixer, or Lodige mixer. Optionally, coarse particles may be removed from the developer, for example using a vibrating sieve or air-jet sieve.

External Additives

An example of an external additive is inorganic particles. Examples of inorganic particles include particles of $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

As an external additive, inorganic particles may have a hydrophobic surface created by hydrophobization, for example by immersion in a hydrophobizing agent. The hydrophobizing agent may be of any kind, but examples include silane coupling agents, silicone oil, titanate coupling agents, and aluminum coupling agents. One such agent may be used alone, or two or more may be used in combination.

The amount of hydrophobizing agent is usually, for example, 1 part by mass or more and 10 parts by mass or less per 100 parts by mass of the inorganic particles.

Materials like resin particles (particles of polystyrene, polymethyl methacrylate, melamine resins, etc.) and active cleaning agents (e.g., metal salts of higher fatty acids, typically zinc stearate, and particles of fluoropolymers) are also examples of external additives.

The percentage of external additives may be 0.01% by mass or more and 5% by mass or less, preferably 0.01% by mass or less and 2.0% by mass or less, of the toner particles.

Image Forming Apparatus and Image Forming Method

An image forming apparatus according to an exemplary embodiment includes an image carrier; a charging component that charges the surface of the image carrier; an electrostatic charge image creating component that creates an electrostatic charge image on the charged surface of the image carrier; a developing component that contains an electrostatic charge image developer and develops, using the electrostatic charge image developer, the electrostatic charge image created on the surface of the image carrier to form a toner image; a transfer component that transfers the toner image on the surface of the image carrier to the surface of a recording medium; and a fixing component that fixes the toner image on the surface of the recording medium. The electrostatic charge image developer is an electrostatic charge developer according to the above exemplary embodiment.

The image forming apparatus according to this exemplary embodiment performs an image forming method (image forming method according to an exemplary embodiment) that includes charging the surface of an image carrier; creating an electrostatic charge image on the charged surface of the image carrier; developing, using an electrostatic charge image developer according to the above exemplary embodiment, the electrostatic charge image created on the surface of the image carrier to form a toner image; transferring the toner image on the surface of the image carrier to the surface of a recording medium; and fixing the toner image on the surface of the recording medium.

The configuration of the image forming apparatus according to this exemplary embodiment is applied to known types of image forming apparatuses.

Examples include direct-transfer apparatuses, which transfer a toner image formed on the surface of an image carrier directly to a recording medium; intermediate-transfer apparatuses, which transfer a toner image formed on the surface of an image carrier to the surface of an intermediate transfer body (first transfer), and then transfer the toner image on the surface of the intermediate transfer body to the surface of a recording medium (second transfer); apparatuses that include a cleaning component that cleans the surface of the image carrier between the transfer of the toner image and charging; and apparatuses that have a static eliminator, which removes static electricity from the surface of the image carrier by irradiating the surface with antistatic light between the transfer of the toner image and charging.

If the image forming apparatus according to this exemplary embodiment is made as an intermediate-transfer apparatus, the transfer component includes, for example, an intermediate transfer body, a first transfer component, and a second transfer component. The toner image formed on the surface of the image carrier is transferred to the surface of the intermediate transfer body by the first transfer component (first transfer), and then the toner image on the surface of the intermediate transfer body is transferred to the surface of a recording medium by the second transfer component (second transfer).

Part of the image forming apparatus according to this exemplary embodiment, e.g., a portion including the developing component, may have a cartridge structure, i.e., a structure that allows the part to be attached to and detached from the image forming apparatus (or may be a process cartridge). An example of a process cartridge is one that contains the electrostatic charge image developer according to the above exemplary embodiment and includes the developing component.

The following describes an example of an image forming apparatus according to this exemplary embodiment. It should be noted that the image forming apparatus according to this exemplary embodiment is not limited to this example. The following description is focused on structural elements illustrated in a drawing.

FIG. 1 schematically illustrates the structure of an image forming apparatus according to this exemplary embodiment.

The image forming apparatus illustrated in FIG. 1 includes first to fourth electrophotographic image forming units 10Y, 10M, 10C, and 10K (image forming component) that produce images in the colors of yellow (Y), magenta (M), cyan (C), and black (K), respectively, based on color-separated image data. The image forming units (hereinafter also referred to simply as "units") 10Y, 10M, 10C, and 10K are arranged in a horizontal row with a predetermined distance therebetween. The units 10Y, 10M, 10C, and 10K may be process cartridges, i.e., units that are attached to and detached from the image forming apparatus.

Above the units 10Y, 10M, 10C, and 10K is an intermediate transfer belt (example of an intermediate transfer body) 20, which also extends through each of the units. The intermediate transfer belt 20 is wound over a drive roller 22 and a support roller 24 and runs in the direction from the first unit 10Y to the fourth unit 10K. A spring or similar mechanism, not illustrated, applies force to the support roller 24 in the direction away from the drive roller 22, placing tension on the intermediate transfer belt 20 wound over the two rollers. On the image carrier side of the intermediate transfer belt 20 is a cleaning device 30 for the intermediate transfer belt 20, facing the drive roller 22.

The developing devices (example of a developing component) 4Y, 4M, 4C, and 4K of the units 10Y, 10M, 10C, and 10K are supplied with toners in yellow, magenta, cyan, and black, respectively, contained in toner cartridges 8Y, 8M, 8C, and 8K.

The first to fourth units 10Y, 10M, 10C, and 10K are equivalent in structure and operation. In the following, the first unit 10Y, which is located upstream of the others in the direction of running of the intermediate transfer belt 20 and forms a yellow image, is described to represent the four units.

The first unit 10Y has a photoreceptor 1Y that operates as an image carrier. Around the photoreceptor 1Y are a charging roller (example of a charging component) 2Y that charges the surface of the photoreceptor 1Y to a predetermined potential; an exposure device (example of an electrostatic charge image creating component) 3 that irradiates the charged surface with a laser beam 3Y based on a color-separated image signal to create an electrostatic charge image there; a developing device (example of a developing component) 4Y that supplies charged toner to the electrostatic charge image to develop the electrostatic charge image; a first transfer roller (example of a first transfer component) 5Y that transfers the developed toner image to the intermediate transfer belt 20; and a photoreceptor cleaning device (example of a cleaning component) 6Y that removes residual toner off the surface of the photoreceptor 1Y after the first transfer, arranged in this order.

The first transfer roller 5Y is inside the intermediate transfer belt 20 and faces the photoreceptor 1Y. The first transfer rollers 5Y, 5M, 5C, and 5K of the units are connected to bias power supplies (not illustrated), which apply a first transfer bias to the rollers. The bias power supplies change the value of the transfer bias they apply to the first transfer rollers under the control of a controller, not illustrated.

The following describes how the first unit 10Y operates to form a yellow image.

First, the charging roller 2Y charges the surface of the photoreceptor 1Y to a potential of −600 V to −800 V beforehand.

The photoreceptor 1Y is a stack of an electrically conductive (e.g., a volume resistivity at 20° C. of $1\times10^{-6}$ Ωcm or less) substrate and a photosensitive layer thereon. The photosensitive layer is highly resistant (has the typical resistance of resin) in its normal state, but when it is irradiated with a laser beam, the resistivity of the irradiated portion changes. Thus, the charged surface of the photoreceptor 1Y is irradiated with a pattern of a laser beam 3Y that the exposure device 3 emits on the basis of data for the yellow image sent from a controller, not illustrated. This creates an electrostatic charge image as a pattern for the yellow image on the surface of the photoreceptor 1Y.

The electrostatic charge image is an image created on the surface of the photoreceptor 1Y as a result of charging. Once the laser beam 3Y reduces the resistivity of the irradiated portion of the photosensitive layer, the charge on the surface of the photoreceptor 1Y flows away. The charge on the portion not irradiated with the laser beam 3Y stays. The resulting electrostatic charge image is therefore a so-called negative latent image.

As the photoreceptor 1Y rotates, the electrostatic charge image created on the photoreceptor 1Y moves to a predetermined development point. At the development point, the developing device 4Y develops the electrostatic charge image on the photoreceptor 1Y into a visible toner image.

Inside the developing device 4Y is an electrostatic charge image developer that contains, for example, at least yellow toner and a carrier. The yellow toner is on a developer roller (example of a developer carrier) and has been triboelectrically charged with the same polarity as the charge on the photoreceptor 1Y (negative) as a result of stirring inside the developing device 4Y. The surface of the photoreceptor 1Y passes through this developing device 4Y, during which the yellow toner electrostatically adheres to the uncharged, latent image portion of the surface of the photoreceptor 1Y, thereby developing the latent image. Then the photoreceptor 1Y, with a yellow toner image thereon, continues running at a predetermined speed to transport the developed toner image thereon to a predetermined first transfer point.

After the arrival of the yellow toner image on the photoreceptor 1Y at the first transfer point, a first transfer bias is applied to the first transfer roller 5Y. Electrostatic force directed from the photoreceptor 1Y to the first transfer roller 5Y acts on the toner image on the photoreceptor 1Y to transfer it to the intermediate transfer belt 20. The applied transfer bias has the (+) polarity, opposite the polarity of the toner (−), and its amount is controlled by a controller (not illustrated) to, for example, +10 μA for the first unit 10Y.

Residual toner on the photoreceptor 1Y is removed and collected at the photoreceptor cleaning device 6Y.

The first transfer biases applied to the first transfer rollers 5M, 5C, and 5K of the second, third, and fourth units 10M, 10C, and 10K are also controlled in the same was as that to the first unit 10Y.

The intermediate transfer belt 20 to which a yellow toner image has been transferred at the first unit 10Y in this way is then moved to pass through the second to fourth units 10M, 10C, and 10K sequentially. Toner images in the respective colors are overlaid, completing multilayer transfer.

After this multilayer transfer of toner images in four colors by passing through the first to fourth units, the intermediate transfer belt 20 reaches the second transfer section, formed by the intermediate transfer belt 20, the support roller 24 touching the inner surface of the intermediate transfer belt 20, and the second transfer roller (example of a second transfer component) 26 on the image-carrying side of the intermediate transfer belt 20. Recording paper (example of a recording medium) P is delivered to the point of contact between the second transfer roller 26 and the intermediate transfer belt 20 in a timed manner by a feeding mechanism, and a second transfer bias is applied to the support roller 24. The applied transfer bias has the (−) polarity, the same as the polarity of the toner (−). Electrostatic force directed from the intermediate transfer belt 20 to the recording paper P acts on the toner image on the intermediate transfer belt 20 to transfer it to the recording paper P. The amount of the second transfer bias is controlled; it is determined in accordance with the resistance detected by a resistance detector (not illustrated) that detects the resistance of the second transfer section.

Then the recording paper P is sent to the point of pressure contact (nip) between a pair of fixing rollers at a fixing device (example of a fixing component) 28. The toner image is fixed on the recording paper P, producing a fixed image.

Examples of types of recording paper P to which the toner image is transferred include ordinary printing paper for copiers, printers, etc., of electrophotographic type. In addition to recording paper P, overhead-projector (OHP) film is also an example of a recording medium.

For improved smoothness of the surface of the fixed image, the recording paper P may have a smooth surface. For example, coated paper, which is paper having a coated surface, for example a resin-coated surface, or art paper for printing purposes may be used.

After the completion of the fixation of the color image, the recording paper P is transported to an ejection section to finish the formation of a color image.

Process Cartridge

A process cartridge according to an exemplary embodiment includes a developing component that contains an electrostatic charge image developer according to an above exemplary embodiment and develops, using the electrostatic charge image developer, an electrostatic charge image created on the surface of an image carrier to form a toner image. The process cartridge is attached to and detached from an image forming apparatus.

The process cartridge according to this exemplary embodiment is not limited to this configuration. In addition to the developing component, it may optionally have, for example, at least one selected from other components like an image carrier, a charging component, an electrostatic charge image creating component, and a transfer component.

The following describes an example of a process cartridge according to this exemplary embodiment. It should be noted that the process cartridge according to this exemplary embodiment is not limited to this example. The following description is focused on structural elements illustrated in a drawing.

Figure 2:
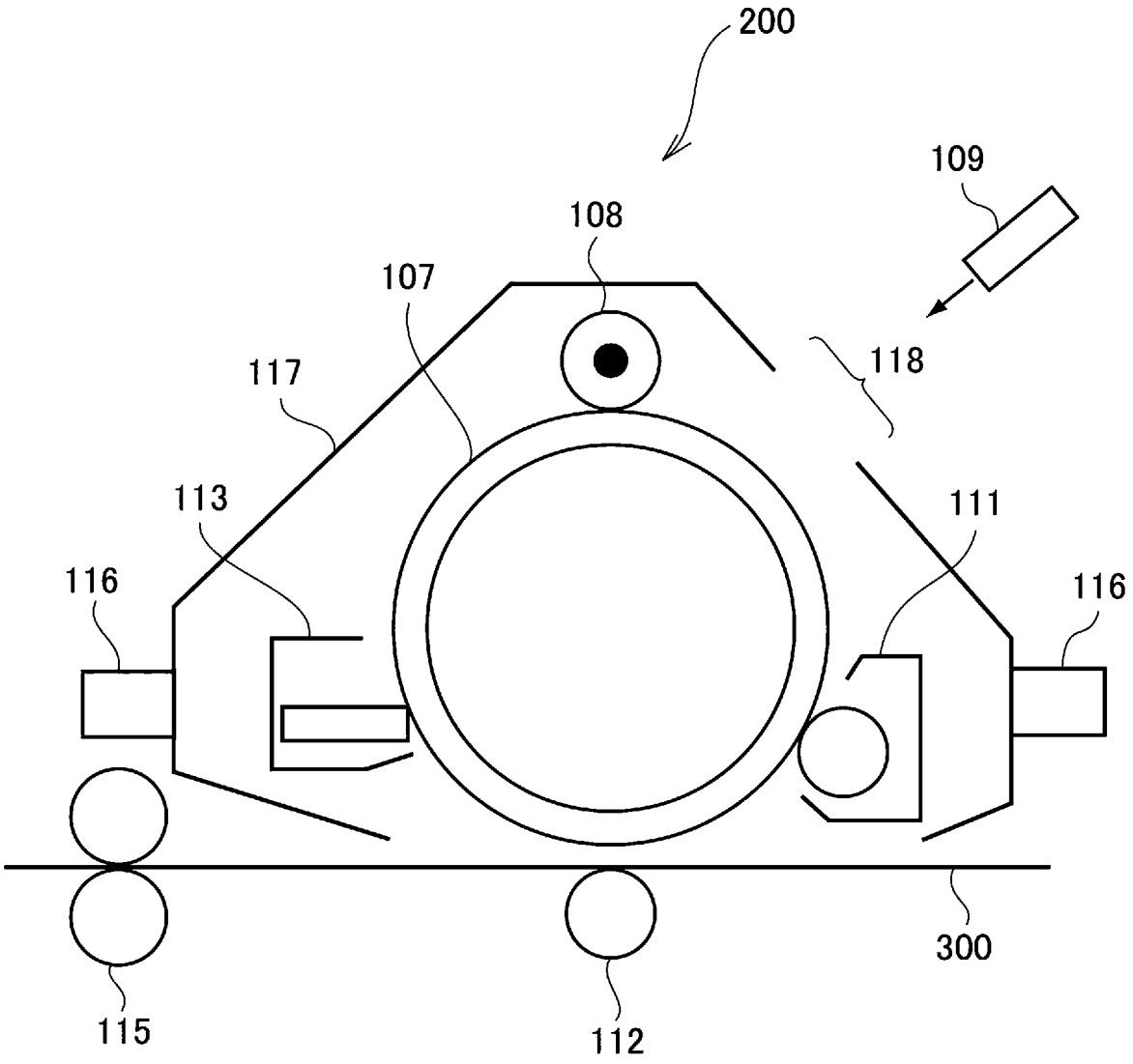
FIG. 2 schematically illustrates the structure of an example of a process cartridge according to an exemplary embodiment that is attached to and detached from an image forming apparatus.

FIG. 2 schematically illustrates the structure of a process cartridge according to this exemplary embodiment.

The process cartridge 200 illustrated in FIG. 2 is a cartridge made by, for example, holding a photoreceptor 107 (example of an image carrier) and its peripheral components together in a housing 117 that has attachment rails 116 and an opening 118 for exposure to light. The peripheral components are a charging roller 108 (example of a charging component), a developing device 111 (example of a developing component), and a photoreceptor-cleaning device 113 (example of a cleaning component).

FIG. 2 also includes an exposure device 109 (example of an electrostatic charge image creating component), a transfer device 112 (example of a transfer component), a fixing device 115 (example of a fixing component), and recording paper 300 (example of a recording medium).

EXAMPLES

The following describes exemplary embodiments of the present disclosure by providing examples, but the exemplary embodiments of the present disclosure are not limited to these Examples. In the following description, "parts" and are by mass unless stated otherwise.

Production of Toner Particles

Production of a Liquid Dispersion of an Amorphous Polyester Resin (A1)

Ethylene glycol: 37 parts
Neopentyl glycol: 65 parts
1,9-Nonanediol: 32 parts
Terephthalic acid: 96 parts These materials are loaded into a flask and heated to a temperature of 200° C. over 1 hour. After the reaction system has been stirred to uniformity, 1.2 parts of dibutyltin oxide is added. The temperature is increased to 240° C. over 6 hours while the water produced is removed by distillation, and stirring is continued for 4 hours at 240° C. This gives an amorphous polyester resin (acid value, 9.4 mg KOH/g; weight-average molecular weight, 13,000; glass transition temperature, 62° C.). The molten amorphous polyester resin is transferred to an emulsifying and dispersing machine (Cavitron CD1010, Eurotec) at a speed of 100 g per minute. Separately, reagent-grade aqueous ammonia is diluted with deionized water to a concentration of 0.37%. The resulting dilute aqueous ammonia is put into a tank and then, simultaneously with the amorphous polyester resin, transferred to the emulsifying and dispersing machine at a speed of 0.1 liters per minute while being heated to 120° C. in a heat exchanger. The emulsifying and dispersing machine is operated at a rotor speed of 60 Hz and a pressure of 5 kg/cm$^2$. This gives a 20%-solids liquid dispersion of an amorphous polyester resin (A1) in which the volume-average diameter of particles is 160 nm.

Production of a Liquid Dispersion of a Crystalline Polyester Resin (C1)

Decanedioic acid: 81 parts
Hexanediol: 47 parts

These materials are loaded into a flask and heated to a temperature of 160° C. over 1 hour. After the reaction system has been stirred to uniformity, 0.03 parts of dibutyltin oxide is added. The temperature is increased to 200° C. over 6 hours while the water produced is removed by distillation, and stirring is continued for 4 hours at 200° C. Then the reaction solution is cooled until solids separate out, and the solids are collected and dried at a temperature of 40° C. under reduced pressure. This gives a crystalline polyester resin (C1) (melting point, 64° C.; weight-average molecular weight, 15,000).

The crystalline polyester resin (C1): 50 parts
An anionic surfactant (Neogen RK, DKS Co., Ltd.): 2 parts
Deionized water: 200 parts These materials are heated to 120° C. and sufficiently dispersed using a homogenizer (ULTRA-TURRAX T50, IKA). The resulting dispersion is subjected to further dispersion using a pressure-pump homogenizer and collected when the volume-average particle diameter is 180 nm. The dispersion obtained is a 20%-solids liquid dispersion of a crystalline polyester resin (C1).

Production of a Liquid Dispersion of Release-Agent Particles (W1)

Paraffin wax (HNP-9, Nippon Seiro Co., Ltd.): 100 parts
An anionic surfactant (Neogen RK, DKS Co., Ltd.): 1 part
Deionized water: 350 parts These materials are mixed together and heated to 100° C., dispersed using a homogenizer (IKA ULTRA-TURRAX T50), and then further dispersed using a pressure-pump Gaulin homogenizer. This gives a liquid dispersion of release-agent particles having a volume-average diameter of 200 nm. The solids content is adjusted to 20% with deionized water to complete a liquid dispersion of release-agent particles (W1).

Production of a Liquid Dispersion of Coloring-Agent Particles (K1)

Carbon black (Regal 330, Cabot): 50 parts

An anionic surfactant (Neogen RK, DKS Co., Ltd.): 5 parts

Deionized water: 195 parts

These materials are mixed together and dispersed for 10 minutes at 240 MPa using an Ultimaizer (Sugino Machine). This gives a 20%-solids liquid dispersion of coloring-agent particles (K1).

Production of Toner Particles

Deionized water: 200 parts

The liquid dispersion of an amorphous polyester resin (A1): 150 parts

The liquid dispersion of a crystalline polyester resin (C1): 10 parts

The liquid dispersion of release-agent particles (W1): 10 parts

The liquid dispersion of coloring-agent particles (K1): 15 parts

An anionic surfactant (TaycaPower): 2.8 parts

These materials are put into a stainless-steel round-bottom flask, the pH is adjusted to 3.5 with 0.1 N nitric acid, and then an aqueous solution of polyaluminum chloride prepared by dissolving 2 parts of polyaluminum chloride (Oji Paper Co., Ltd.; 30% powder) in 30 parts of deionized water is added. After dispersion at 30° C. using a homogenizer (IKA ULTRA-TURRAX T50), the mixture is heated to 45° C. in an oil bath for heating, and this state is maintained until the volume-average diameter of particles is 4.9 μm. Then 60 parts of the liquid dispersion of an amorphous polyester resin (A1) is added, and the mixture is allowed to stand for 30 minutes. When the volume-average diameter of particles is 5.2 μm, another 60 parts of the liquid dispersion of an amorphous polyester resin (A1) is added, and the mixture is allowed to stand for 30 minutes. Then 20 parts of a 10% aqueous solution of a metal salt of nitrilotriacetic acid (NTA) (CHELEST 70, Chelest Corporation) is added, and the pH is adjusted to 9.0 with a 1 N aqueous solution of sodium hydroxide. Then 1 part of the anionic surfactant (TaycaPower) is added, the mixture is heated to 85° C. with continued stirring, and this state is maintained for 5 hours. Then the mixture is cooled to 20° C. at a rate of 20° C./min, the cooled mixture is filtered, and the residue is washed thoroughly with deionized water and dried. This gives toner particles (1) having a volume-average diameter of 5.7 μm and an average roundness of 0.971.

Production of Layered-Compound Particles

Production of Melamine Cyanurate Particles

A commercially available melamine cyanurate (MC-4500, Nissan Chemical) is milled and classified using a jet mill into types of melamine cyanurate particles (1) to (5). Table 1 summarizes the volume-average diameter of melamine cyanurate particles (1) to (5). In Table 1, "MC" refers to melamine cyanurate.

Preparation of Boron Nitride Particles

Commercially available boron nitride particles (AP-10S, MARUKA) are used. Their volume-average diameter is 2.4 μm. In Table 1, "BN" refers to boron nitride.

Production of Resin-Coated Carriers

Production of Resin-Coated Carrier (1)

Raw materials weighed out in proportions that give the following composition are mixed with water: MnO, 35 mol %; MgO, 14.5 mol %; $Fe_2O_3$, 50 mol %; SrO, 0.5 mol %. The mixture is milled using a wet medium mill for 5 hours to give slurry. Drying the slurry using a spray dryer gives spherical particles. Spherical particles within a particular range of sizes are calcined at 950° C. for 2 hours. The calcined particles are milled using a wet medium mill with 0.3-cm stainless-steel beads for 1 hour, and then with 0.5-cm zirconia beads for 4 hours. As a binder, a quantity of polyvinyl alcohol corresponding to 0.8% by mass of the solids in the particles is added. The resulting mixture is granulated and dried using a spray dryer, and the dried grains are fired by leaving them at a temperature of 1350° C. for 5 hours in an electric furnace. The fired grains are crushed, the crushed particles are classified, and particles within a particular range of sizes are screened by magnetic separation to isolate weakly magnetic particles. The resulting particles are ferrite particles (1). The volume-average diameter of ferrite particles (1) is 35 μm.

Separately, cyclohexyl methacrylate is added to a 0.3% by mass aqueous solution of sodium benzenesulfonate, and an amount of potassium persulfate corresponding to 0.5% by mass of the total amount of the monomer is added to induce emulsion polymerization. Spray-drying the resulting solution gives coating resin (1). The weight-average molecular weight of coating resin (1) is 400,000.

In a high-speed stirring mixer having horizontal rotor blades, 100 parts by mass of ferrite particles (1) and 4.5 parts by mass of coating resin (1) are stirred at 22° C. for 15 minutes and then at 120° C. for 50 minutes, both under conditions under which the blades rotate at a circumferential speed of 8 m/sec, to form a resin layer on the surface of ferrite particles (1). Fine and coarse powders are removed from the resulting crude resin-coated carrier by elbow-jet classification to complete resin-coated carrier (1). The volume-average diameter of particles in resin-coated carrier (1) is 36 μm.

Production of Resin-Coated Carrier (2)

Resin-coated carrier (2) is produced in the same way as resin-coated carrier (1), except that the amount of coating resin (1) is changed to 4.8 parts by mass.

Production of Resin-Coated Carrier (3)

Resin-coated carrier (3) is produced in the same way as resin-coated carrier (1), except that the amount of coating resin (1) is changed to 4.3 parts by mass.

Production of Resin-Coated Carrier (4)

Resin-coated carrier (4) is produced in the same way as resin-coated carrier (1), except that the amount of coating resin (1) is changed to 3.7 parts by mass.

Table 1 summarizes the maximum height Ry of the roughness profile of the surface for resin-coated carriers (1) to (4).

Example 1

In a sample mill, 100 parts by mass of toner particles (1), 1.5 parts by mass of hydrophobic silica particles (RY50, Nippon Aerosil), and 0.12 parts by mass of melamine cyanurate particles (1) are mixed for 30 seconds at 10000 rpm. Screening the mixture using a vibrating sieve with a pore size of 45 μm gives a toner in which the volume-average diameter of particles is 5.7 μm. The toner and carrier (1) are put into a V-blender in a ratio of 5:100 (toner to carrier (1); by mass) and stirred for 20 hours to complete a developer.

Examples 2 to 12 and Comparative Examples 1 and 2

Toners and developers are obtained in the same way as in Example 1, except that the type and/or amount of layered-compound particles or the type of resin-coated carrier is changed.

Performance Testing

Developer Bead Carryover (BCO)

Using Fuji Xerox's Iridesse Production Press as an image forming apparatus, an image with an area coverage of 0.5% is printed on 50,000 sheets of A4 ordinary printing paper (C2 paper, Fuji Xerox) under the conditions of a temperature of 30° C. and a relative humidity of 88%, with no trickle carrier supplied. Then a full-page half-tone image is printed on a sheet of A3 ordinary printing paper (C2 paper, Fuji Xerox). Performance is graded by the number of carrier particles on the half-tone image as follows.

G1: Zero.

G2: One to three.

G3: Four to six. Acceptable.

G4: Seven or more. Practically unacceptable.

Toner Starvation (STV)

After the above image formation task, the image forming apparatus is moved to an environment at a temperature of 10° C. and a relative humidity of 15% and left overnight. Then, under the conditions of a temperature of 10° C. and a relative humidity of 15%, 100 sheets of A4 ordinary printing paper (C2 paper, Fuji Xerox) are passed through the image forming apparatus, and an image with an area coverage of 50% is printed on 50,000 sheets of A4 ordinary printing paper (C2 paper, Fuji Xerox) with no trickle carrier supplied. Then a test chart for toner starvation is printed on a sheet of A4 ordinary printing paper (C2 paper, Fuji Xerox). The test chart is visually inspected, and performance is graded as follows.

G1: The image has no sign of misregistration.

G2: The image has a minor sign of misregistration, but it is so minor that it cannot be noticed at a glance.

G3: The image has a minor sign of misregistration. Acceptable.

G4: The image has a clear sign of misregistration. Practically unacceptable.

TABLE 1

| | Layered-compound particles | | | Resin-coated carrier | | | Testing | |
|---|---|---|---|---|---|---|---|---|
| | Type | Volume-average diameter [μm] | Amount [parts by mass/100 parts by mass of toner particles] | Type | Ry [μm] | Volume-average diameter [μm] | BCO | STV |
| Comparative Example 1 | — | — | 0 | (1) | 0.05 | 36 | G4 | G1 |
| Example 1 | MC(1) | 4 | 0.12 | (1) | 0.05 | 36 | G1 | G1 |
| Example 2 | MC(1) | 4 | 0.12 | (2) | 0.01 | 36 | G3 | G1 |
| Example 3 | MC(1) | 4 | 0.12 | (3) | 0.12 | 36 | G2 | G3 |
| Comparative Example 2 | MC(1) | 4 | 0.12 | (4) | 0.21 | 36 | G2 | G4 |
| Example 4 | MC(2) | 0.4 | 0.12 | (1) | 0.05 | 36 | G2 | G2 |
| Example 5 | MC(3) | 9 | 0.12 | (1) | 0.05 | 36 | G1 | G2 |
| Example 6 | MC(4) | 13 | 0.12 | (1) | 0.05 | 36 | G2 | G3 |
| Example 7 | MC(5) | 22 | 0.12 | (1) | 0.05 | 36 | G3 | G3 |
| Example 8 | MC(1) | 4 | 0.01 | (1) | 0.05 | 36 | G3 | G1 |
| Example 9 | MC(1) | 4 | 0.29 | (1) | 0.05 | 36 | G2 | G2 |
| Example 10 | MC(1) | 4 | 0.46 | (1) | 0.05 | 36 | G1 | G3 |
| Example 11 | MC(1) | 4 | 0.52 | (1) | 0.05 | 36 | G1 | G3 |
| Example 12 | BN | 2.4 | 0.12 | (1) | 0.05 | 36 | G2 | G2 |

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An electrostatic charge image developer comprising:

toner particles;

layered-compound particles that are particles of a nitrogen-containing layered compound; and a resin-coated carrier that has magnetic particles and a resin layer covering the magnetic particles, a maximum height Ry of the roughness profile as defined in JIS B0601: 1994 of a surface of the resin-coated carrier being 0.01 μm or more and 0.20 μm or less.

2. The electrostatic charge image developer according to claim 1, wherein the maximum height Ry of the roughness profile as defined in JIS B0601: 1994 of the surface of the resin-coated carrier is 0.01 μm or more and 0.10 μm or less.

3. The electrostatic charge image developer according to claim 2, wherein the layered-compound particles have a volume-average diameter of 0.1 μm or more and 20 μm or less.

4. The electrostatic charge image developer according to claim 3, wherein a layered-compound particle content is 0.01 parts by mass or more and 0.50 parts by mass or less per 100 parts by mass of the toner particles.

5. The electrostatic charge image developer according to claim 4, wherein the layered-compound particle content is 0.01 parts by mass or more and 0.30 parts by mass or less per 100 parts by mass of the toner particles.

6. The electrostatic charge image developer according to claim 3, wherein the layered-compound particles have a volume-average diameter of 0.3 μm or more and 10 μm or less.

7. The electrostatic charge image developer according to claim 2, wherein a layered-compound particle content is 0.01 parts by mass or more and 0.50 parts by mass or less per 100 parts by mass of the toner particles.

8. The electrostatic charge image developer according to claim 7, wherein the layered-compound particle content is 0.01 parts by mass or more and 0.30 parts by mass or less per 100 parts by mass of the toner particles.

9. The electrostatic charge image developer according to claim 2, wherein the layered-compound particles include at least one selected from the group consisting of melamine cyanurate particles and boron nitride particles.

10. The electrostatic charge image developer according to claim 1, wherein the layered-compound particles have a volume-average diameter of 0.1 μm or more and 20 μm or less.

11. The electrostatic charge image developer according to claim 10, wherein the layered-compound particles have a volume-average diameter of 0.3 μm or more and 10 μm or less.

12. The electrostatic charge image developer according to claim 10, wherein a layered-compound particle content is 0.01 parts by mass or more and 0.50 parts by mass or less per 100 parts by mass of the toner particles.

13. The electrostatic charge image developer according to claim 12, wherein the layered-compound particle content is 0.01 parts by mass or more and 0.30 parts by mass or less per 100 parts by mass of the toner particles.

14. The electrostatic charge image developer according to claim 10, wherein the layered-compound particles include at least one selected from the group consisting of melamine cyanurate particles and boron nitride particles.

15. The electrostatic charge image developer according to claim 1, wherein a layered-compound particle content is 0.01 parts by mass or more and 0.50 parts by mass or less per 100 parts by mass of the toner particles.

16. The electrostatic charge image developer according to claim 15, wherein the layered-compound particle content is 0.01 parts by mass or more and 0.30 parts by mass or less per 100 parts by mass of the toner particles.

17. The electrostatic charge image developer according to claim 1, wherein the layered-compound particles include at least one selected from the group consisting of melamine cyanurate particles and boron nitride particles.

18. A process cartridge that is attached to and detached from an image forming apparatus, the process cartridge comprising a developing component that contains the electrostatic charge image developer according to claim 1 and develops, using the electrostatic charge image developer, an electrostatic charge image created on a surface of an image carrier to form a toner image.

19. An image forming apparatus comprising:

an image carrier;

a charging component that charges a surface of the image carrier;

an electrostatic charge image creating component that creates an electrostatic charge image on the charged surface of the image carrier;

a developing component that contains the electrostatic charge image developer according to claim 1 and develops, using the electrostatic charge image developer, the electrostatic charge image created on the surface of the image carrier to form a toner image;

a transfer component that transfers the toner image on the surface of the image carrier to a surface of a recording medium; and a fixing component that fixes the toner image on the surface of the recording medium.

20. An image forming method comprising:

charging a surface of an image carrier;

creating an electrostatic charge image on the charged surface of the image carrier;

developing, using the electrostatic charge image developer according to claim 1, the electrostatic charge image created on the surface of the image carrier to form a toner image;

transferring the toner image on the surface of the image carrier to a surface of a recording medium; and fixing the toner image on the surface of the recording medium.

* * * * *